US007963225B2

(12) United States Patent
Hahn

(10) Patent No.: US 7,963,225 B2
(45) Date of Patent: Jun. 21, 2011

(54) METHOD FOR CONTROLLING AND/OR ADJUSTING A REGISTER IN A PRINTING MACHINE AND A DEVICE FOR CONTROLLING AND/OR ADJUSTING A CIRCUMFERENTIAL REGISTER

(75) Inventor: Oliver Frank Hahn, Veitshöchheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 860 days.

(21) Appl. No.: 11/886,429

(22) PCT Filed: Apr. 19, 2006

(86) PCT No.: PCT/EP2006/061653

§ 371 (c)(1),
(2), (4) Date: Sep. 14, 2007

(87) PCT Pub. No.: WO2006/117291

PCT Pub. Date: Sep. 9, 2006

(65) Prior Publication Data

US 2008/0105153 A1 May 8, 2008

(30) Foreign Application Priority Data

May 4, 2005 (DE) ..... 10 2005 020 728
May 6, 2005 (DE) ..... 10 2005 021 148

(51) Int. Cl.
*B41F 1/34* (2006.01)

(52) U.S. Cl. ..... 101/485; 101/248

(58) Field of Classification Search ..... 101/485, 101/248

See application file for complete search history.

(56) References Cited

U.S. PATENT DOCUMENTS

| | | | | |
|---|---|---|---|---|
| 3,701,464 | A | 10/1972 | Crum | |
| 3,742,849 | A * | 7/1973 | Greiner et al. | 101/220 |
| 3,841,216 | A * | 10/1974 | Huffman | 101/181 |
| 4,572,074 | A * | 2/1986 | Guaraldi | 101/484 |
| 4,614,155 | A * | 9/1986 | Shimizu | 101/248 |
| 5,412,577 | A | 5/1995 | Sainio et al. | |
| 5,689,425 | A | 11/1997 | Sainio et al. | |
| 5,771,805 | A | 6/1998 | Branas et al. | |
| 6,293,194 | B1 | 9/2001 | Vrotacoe | |
| 6,499,397 | B2 * | 12/2002 | Stern | 101/248 |
| 6,505,555 | B2 * | 1/2003 | Kanda | 101/217 |
| 6,526,889 | B2 * | 3/2003 | Tokiwa | 101/485 |

(Continued)

FOREIGN PATENT DOCUMENTS

DE 44 33 905 A1 4/1995

(Continued)

*Primary Examiner* — Anthony H. Nguyen
(74) *Attorney, Agent, or Firm* — Jones, Tullar & Cooper, P.C.

(57) ABSTRACT

A register in a printing machine is controlled and adjusted by providing at least one printing unit provided with at least two printing groups in the printing machine. Each printing group comprises a cylinder pair consisting of at least a forme cylinder and a transfer cylinder. The forme cylinder of the first printing group is phase shifted at a first amount for the register adjustment in a circumferential direction. The transfer cylinder of the first printing group is phase shifted in a second amount in the circumferential direction. The amount of the phase shift of the forme cylinder is different from the amount of phase shift of the transfer cylinder. The two amounts of the phase shifts are not equal to zero.

13 Claims, 5 Drawing Sheets

U.S. PATENT DOCUMENTS

| | | | | |
|---|---|---|---|---|
| 6,568,323 | B2 * | 5/2003 | Tokiwa | 101/227 |
| 6,647,874 | B1 | 11/2003 | Siegl et al. | |
| 7,096,789 | B2 * | 8/2006 | Hammond et al. | 101/486 |
| 2001/0045166 | A1 | 11/2001 | Albus et al. | |
| 2002/0185022 | A1 * | 12/2002 | Stieler et al. | 101/216 |
| 2004/0134364 | A1 | 7/2004 | Schultze et al. | |
| 2005/0284316 | A1 | 12/2005 | Rugamer | |

FOREIGN PATENT DOCUMENTS

| | | | |
|---|---|---|---|
| DE | 103 38 973 | A1 | 4/2004 |
| EP | 0 598 490 | A1 | 5/1994 |
| EP | 0 806 294 | A2 | 4/1997 |
| EP | 0 882 587 | A1 | 12/1998 |
| GB | 2 282 565 | | 4/1995 |
| WO | WO 2004/028805 | A1 | 4/2004 |

* cited by examiner

METHOD FOR CONTROLLING AND/OR ADJUSTING A REGISTER IN A PRINTING MACHINE AND A DEVICE FOR CONTROLLING AND/OR ADJUSTING A CIRCUMFERENTIAL REGISTER

CROSS-REFERENCE TO RELATED APPLICATIONS

This application is the U.S. national phase, under 35 USC 371, of PCT/EP2006/061653, filed Apr. 19, 2006; published as WO 2006/117291 A2 and A3 on Nov. 9, 2006 and claiming priority to DE 10 2005 020 728.6, filed May 4, 2005 and to DE 10 2005 021 148.8, filed May 6, 2005, the disclosures of which are expressly incorporated herein by reference.

FIELD OF THE INVENTION

The present invention is directed to methods for controlling and/or for regulating a register in a printing press, as well as to a device for controlling and/or regulating a circumferential register in such a printing press. The printing press has at least one printing unit with at least two printing groups. Each such printing group has a cylinder pair with at least one forme cylinder and one transfer cylinder.

BACKGROUND OF THE INVENTION

The present invention relates, in particular, to those rotary printing presses in which the printing cylinders of the printing groups each have a groove on their cylindrical surface. This groove extends in the longitudinal direction of the cylinder and is used for the fastening of printing plates, rubber blankets or the like to the surface of the cylinder. In the course of the grooves on cooperating cylinder being overrolled, bending vibrations are generated in the printing cylinders. Such bending vibrations lead to fluctuations in the printing tension in the printing gap. Depending on the size or magnitude of these tension fluctuations, they can result in the formation of stripes in the printed product. The interferences which are caused by such groove overrolling, or groove beats, are all the greater, the wider the groove is.

Changing of the circumferential register of cooperating cylinders of a printing group, or of a printing unit, has an effect on the relative position of the grooves of these adjoining, cooperating printing cylinders, such as, for example, a plate cylinder and a rubber blanket cylinder. In the optimal case of an initial position, the grooves of the two cylinders are located exactly opposite each other. In the case of cylinder grooves of equal width, the effective groove width then corresponds to the actual groove width. In the case of cylinder grooves of differing width, the effective groove width is determined by the width of the wider one of the two grooves. However, if the circumferential register is changed, with respect to this initial position, in the case of certain register settings, a noticeable increase of the effective groove width, and therefore a stronger groove beat, can be produced, which stronger groove beat leads to stronger fluctuation stripes in the printed image.

Depending on the type of printing units, and in particular double printing units on the one hand, and satellite printing units on the other hand, different situations result regarding the appearance of groove beats.

In double printing groups, such as, for example, in bridge printing units, a groove beat occurs, on the one hand, in the rubber blanket cylinder-plate cylinder nip of each printing group, and on the other hand, a groove beat occurs in the rubber blanket cylinder-rubber blanket cylinder nip. In the case of an initial position of the adjustment, or of the setting of the circumferential register of 0 mm, the rubber blanket cylinder groove and the plate cylinder groove roll off each other and are centered. The rubber blanket cylinder groove and the plate cylinder groove, as a rule, have different respective widths. Furthermore, in the rubber blanket cylinder-rubber blanket cylinder nip, the two rubber blanket cylinder grooves, which are typically of respectively the same width also roll off each other and they are centered.

If, in the case of the rubber blanket cylinder-plate cylinder nip, the difference in the groove width between the rubber blanket cylinder groove and the plate cylinder groove is less than twice the maximally possible circumferential cylinder adjustment, an enlargement of the effective groove width will occur at certain register settings.

In the case of a register change, either the relative position, or angle of a rubber blanket cylinder with respect to another rubber blanket cylinder, or the relative position or angle of the rubber blanket cylinder to the plate cylinder changes as a function of the drive concept.

In the case of the rubber blanket cylinder-rubber blanket cylinder nip, and based on identical sizes of the two blanket cylinder groove widths, there is always an enlargement of the effective groove width as soon as the register setting of one of the printing groups deviates from that of the other printing group. This is the result when the two rubber blanket cylinder grooves are no longer located exactly opposite each other.

What has been set forth above will now be illustrated by the use of an example of a web-fed rotary offset printing press. A plate cylinder groove is deemed to be 3.1 mm and the rubber blanket cylinder groove is 4.1 mm. A maximum adjustment of the circumferential register, with respect to its initial position, of 2.5 mm, in both directions, is possible.

First to be considered is a double printing group, in which the circumferential register adjustment is performed via the plate cylinder atone, i.e. wherein the relative position of the rubber blanket cylinder, in relation to the plate cylinder, is changed. In accordance with the prior art, and in connection with a common drive mechanism for the entire bridge printing group, such as, for example, a full depth tooth system this adjustment can be accomplished by an oblique tooth arrangement between the rubber blanket cylinder and the plate cylinder. An axial movement of a gear wheel causes an angular change between the two cylinders. In an initial position, the rubber blanket cylinder groove encloses the plate cylinder groove on both sides with a 0.5 mm difference. In this configuration,the width of the rubber blanket cylinder groove determines the extent of vibratory excitation. This effective groove width changes as soon as the circumferential register is adjusted by more than 0.5 mm. Enclosing of the plate cylinder groove by the rubber blanket cylinder groove now no longer occurs, and the effective groove width increases beyond the width of the rubber blanket cylinder groove of 4.1 mm. At a maximum circumferential register adjustment of 2.5 mm, a maximal effective groove width of 6.1 mm results at the plate cylinder rubber blanket cylinder nip.

On the other hand, if a double printing group is being considered, in which a circumferential register adjustment is accomplished by the use of a common adjustment of the plate cylinder and of the rubber blanket cylinder, the relative position of the two rubber cylinders in relation to each other is changed. In accordance with the prior art, such an adjustment can be accomplished, for example, by the use of software, via the drive mechanism control, by a common drive mechanism for each one of the two rubber blanket cylinder-plate cylinder pairs. In accordance with appropriate considerations, a maximum effective groove width of 8.2 mm results in the rubber blanket cylinder-rubber blanket cylinder nip, with an oppositely equal, respectively maximum circumferential register adjustment in the two printing groups.

What has been said above, basically also applies to satellite printing units, to the extent that the plate cylinder-rubber blanket cylinder nip is concerned. However, the considerations regarding the rubber blanket cylinder-rubber blanket cylinder nip do not play a role here, since the counter-pressure cylinder does not have a groove.

Corresponding to the various drive mechanism concepts, in the prior art the circumferential register adjustment is performed in the following manner:

First, the situation in which all of the printing groups of a printing unit have a common main drive mechanism will be considered. In this configuration, all of the rubber blanket cylinders and the plate cylinders of the printing unit are connected by gear teeth, and thus constitute a full depth tooth system. In this configuration, the circumferential registers are adjusted by changing the respective angular positions of the individual plate cylinders. This, as a rule, is done by making use of an oblique tooth arrangement in the gear teeth. Therefore, the above-discussed groove widening occurs, essentially in the rubber blanket cylinder-plate cylinder nip.

Next, the situation in which each printing group of a printing unit has its own main drive, or has a drive mechanism in pairs will be considered. In such a paired drive mechanism, the rubber blanket cylinder and the plate cylinder of each respective printing group are connected with each other by gear teeth. An adjustment of the circumferential register is performed in this configuration by the use of software via the angular position of the drive mechanism. Thus, in the case of the circumferential register adjustment, both cylinders are turned in the same way. Their relative angular position, with respect to each other, does not change, and thus there is no groove widening.

Finally, the situation in which each printing cylinder of a printing unit, either satellite or bridge has its own main drive will be considered. In this configuration there is an individual drive mechanism for the plate cylinder as well as one for the rubber blanket cylinder. Here, depending on the solution selected in accordance with the prior art, to adjust the circumferential register, either the angular position of the plate cylinder will be changed. The situation explained above, in connection with the full depth tooth system, then results. Alternatively, the angular positions of the plate cylinder and of the rubber blanket cylinder are adjusted together. The situation explained above, in connection with the drive in pairs, then results.

A method for driving a processing machine, such as, for example, a web-fed rotary printing press, is known from WO 2004/028825 A1. Several units, which are free of linear shafts, such as printing groups, for example, and a unit for further processing, such as, for example, a folding apparatus, are independently driven by drive mechanisms. Signals from a guide shaft position of a virtual guide shaft are conducted in a signal line which is connecting the drive mechanisms. An offset is assigned to the respective drive mechanisms, which offset fixes a permanent, but adjustable displacement of an angular target position, with respect to the guide shaft position.

A color register system for a printing press is known from EP 0 598 490 A1, in which printed images are monitored by the use of a camera. The appropriate color intensities are compared with reference color intensities which are obtained from the printing plates, and register deviations are thereby appropriately corrected.

It has also already been proposed, for regulating a register in a printing press, that an image sensor takes an image of a printing substrate which has been imprinted in the printing group of the printing press. This image is then evaluated in an evaluating unit. The evaluating unit generates the actuating command for an actuating drive mechanism, for use in adjusting the register, from a comparison of an actually recorded image with the data obtained from a previously recorded image.

A method for detecting interferences with the transport of a web of material in a web-fed rotary printing press is known from DE 103 38 973 A1. The print-to-cutting register is monitored and, if a preset threshold value is exceeded, a trouble signal is generated.

DE 44 33 905 A1 discloses a method for adjusting a circumferential register of a printing press having at least one printing unit. In the course of this method, the circumferential register deviations of all printing groups are determined, and the printing groups of at least one printing unit are individually readjusted.

SUMMARY OF THE INVENTION

The object of the present invention is directed to methods for controlling and/or for regulating a register in a printing press, as well as to a device for controlling and/or for regulating a circumferential register.

In accordance with the present invention, this object is attained by the provision of a printing press having at least one printing unit which has at least two printing groups. Each of these printing groups includes a cylinder pair with at least a forme cylinder and a transfer cylinder. A phase position of a forme cylinder is adjusted in the circumferential direction by a first amount to attain register adjustment. A phase position of the transfer cylinder of the same printing group is adjusted in the circumferential direction by a second amount. The first and second amounts are not the same and both are not equal to zero. A register deviation can be split into several amounts, each of which is applied to a separate forme cylinder.

The advantages which can be achieved by the present invention consist, in particular, in that less waste of printing materials and/or a higher quality of the printed products is achieved because of the adjustments of the cylinder deviations by the use of two different cylinders. The amount of the register deviation is divided into at least two partial amounts.

In one embodiment of the present invention, the advantage lies in that the main part of the register deviation to be readjusted, namely the mean value of the register deviation existing in each printing group, is compensated for by the regulation of the follow-up processing unit, and in particular of the folding station, such as, for example, the folding arrangement. The printing group shafts then only need to compensate for the respectively remaining difference. Thus, the follow-up processing unit, or the folding station, is regulated relative to the web of material, even before the error, which was formed in the printing groups becomes effective. By the use of this, a regulation of the print-to-cutting register is regulated by the use of a superimposed reaction speed.

In another embodiment of the present invention, which can also be combined with a cutting register adjustment, the advantages to be gained by the use of the present invention consist, in particular, in that all of the drive mechanisms of a printing unit, and in particular on the part of the software, are provided with a common adjustment path in accordance with the determined mean value of the register deviations in all of the printing groups of the printing unit. The individual register adjustment of the individual printing groups of the printing unit, by use of the circumferential adjustment of the plate cylinder, is only performed by the amount of the differential adjustment paths resulting from the calculated difference of the mean value and the circumferential register deviations of the individual printing groups.

Since the calculated differential adjustment paths are always less than the originally determined required adjustment paths in the individual printing groups, the increase in the effective groove width is minimized by this within the meaning of the object on which the present invention is based.

The common adjustment $U_{GEM}$ is calculated from the originally required adjustment paths $U_1, U_2, \ldots U_n$ of the n printing groups of a printing unit as the mean value in accordance with $$U_{GEM} = \frac{1}{n}\sum_{i=1}^{n} U_i$$

Added to this are the differential adjustment paths ΔU, which are calculated as deviations from the common adjustment path in accordance with $$\Delta U_i = U_i - U_{GEM}.$$

The required circumferential register adjustment path is now only created to a comparatively small extent, such as, for example, of less than 0.5 mm from non-systematic or statistical deviations from the desired position, as a result of the edges of the plates and the illumination. A large portion of the adjustment path is used for compensating for the differences in the path length between successive print locations of printing units that are arranged along the path of the material to be imprinted, caused by the web path, by web stretching and by roll-off differences of the rubber blankets, or paper feed. Thus, the majority of the required circumferential register adjustment paths is a result of the material to be imprinted, or is a result of the paper web course between successive rubber blanket-paper nips of a web of material to be imprinted, and therefore affects the angular position of all of the printing groups of a printing unit to the same extent.

In the situation of a double printing group, it is therefore possible for the majority of the register adjustment to take place symmetrically, in relation to the web of material to be imprinted, since the nips for both sides of the web of material to be imprinted lie at the same location.

Although, in the case of a satellite printing unit, the nips do not lie at the same location, they are nevertheless located close to each other, so that here, too, a large common adjustment path results in connection with all of the printing groups of the printing unit.

In spite of a good color register, large differences between the register positions on both sides of the web of material to be imprinted can occur in double printing units. This can lead to an undesired increase of the effective groove width in the rubber blanket cylinder-rubber blanket cylinder nip. However, for controlling the color register of an m-color print, the color register adjustment of only N−1 printing groups; wherein N is equal to the whole number amount of the printing groups in the printing press is required. For minimizing the effective groove in the rubber blanket cylinder-rubber blanket cylinder nip, it has therefore been provided that one of the several printing units of the printing press is designated as the reference printing unit, that the circumferential register of the printing units of this reference printing unit is set to "0", and that only the printing groups of the other printing units are readjusted. The selected reference printing unit can be any one of the several printing units. The register adjustments, specifically, the common register adjustment and the differential register adjustment, are therefore performed only on the printing groups of the other printing units.

What has been set forth above also applies to web paths in which printing takes place simultaneously by the use of satellite printing units and also by the use of double printing groups.

A substantial advantage of the present invention is that it can be accomplished purely as a software solution. Because of this aspect of the present invention, existing installations can therefore also be retrofitted in a cost-effective manner.

BRIEF DESCRIPTION OF THE DRAWINGS

Preferred embodiments of the present invention are represented in the drawings and will be described in greater detail in what follows.

Shown are in:

FIG. 1, a schematic representation of a web-fed rotary printing press, in

DESCRIPTION OF PREFERRED EMBODIMENTS

Figure 1:
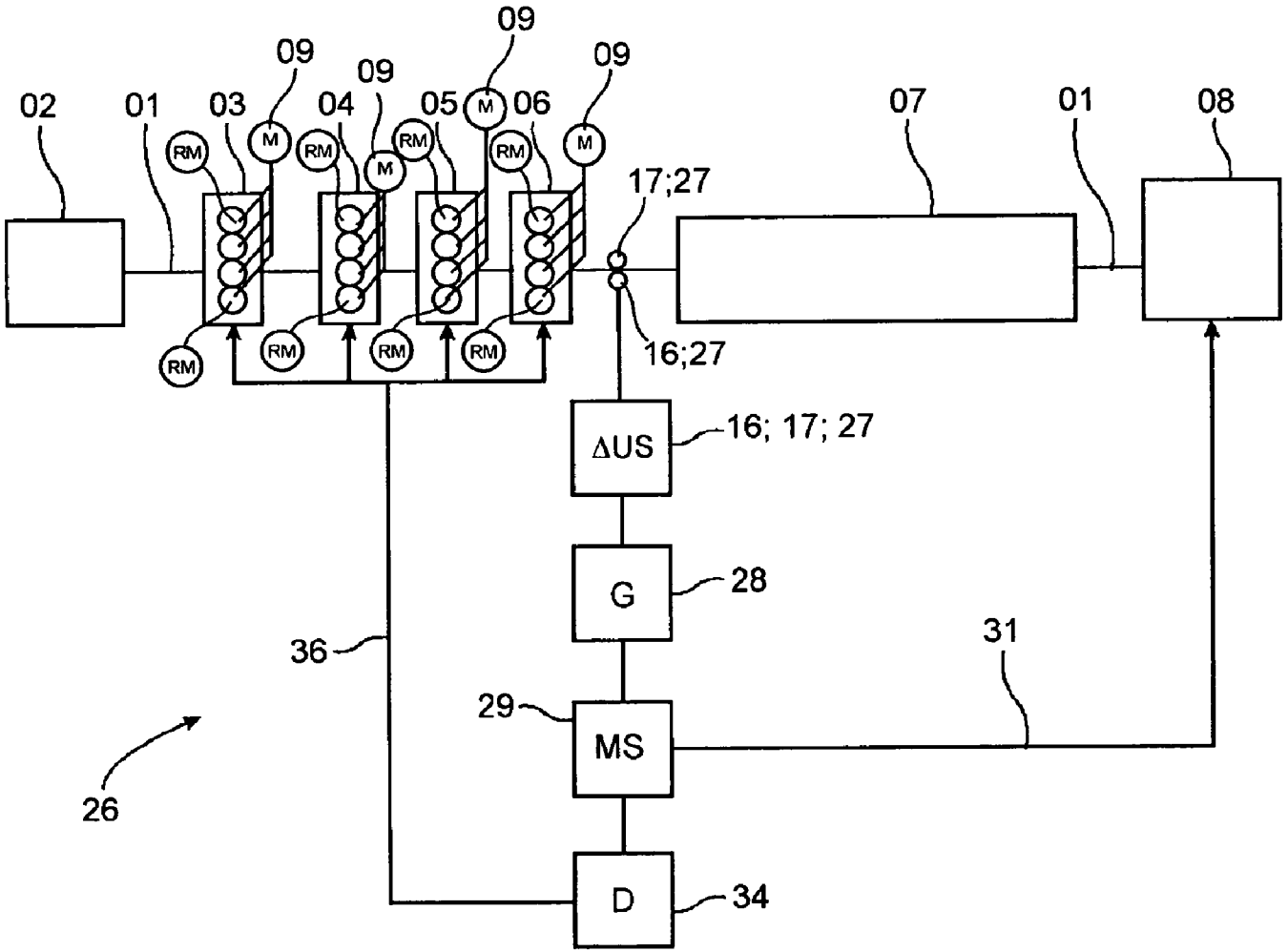

Referring initially to the web-fed rotary offset printing press represented in FIG. 1, a web 01, such as, for example, a web 01 of material to be imprinted, for example a web of material 01, and in particular a paper web 01, is unwound from a non-represented supply roll seated in a roll changer 02. The web 01 is subsequently conducted through a plurality of printing units 03, 04, 05, 06, in which the web 01 of material can be imprinted in color and on both sides. Thereafter, the web 01 of material is conducted through a drying and/or cooling arrangement 07. In a follow-up processing unit 08, such as, for example, a folding arrangement 08, the web 01 is finally cut by the use a cutting cylinder, which is not specifically represented in this drawing figure and, if required, is folded by the use of a folding cylinder. which is also not represented. The web-fed rotary printing press is controlled by a control device, which is also not specifically represented, and which comprises, for example, an arrangement for regulating the print-to-cutting register, identified as a whole by the reference numeral 26, called an arrangement 26 for regulating the cutting register for short in what follows, and which arrangement 26 is connected, by the use of data connectors, which are otherwise not shown in detail, with the individual components of the printing press, and can be essentially housed in a control desk, also not represented in detail, such as, for example, in a control console.

Each printing unit 03, 04, 05, 06 can comprise a forme cylinder 13, a transfer cylinder 14, and at least one counter-pressure cylinder. For making printed products, which are imprinted on both sides, each counter-pressure cylinder is also embodied as a transfer cylinder 14, which, in turn, acts together with a forme cylinder 13 as may be seen in FIG. 2. All of the printing units 03, 04, 05, 06 can be driven mechanically independently of each other, each by the use of drive mechanisms 09, and in particular, by the use of position-controlled electric motors 09.

Figure 2:
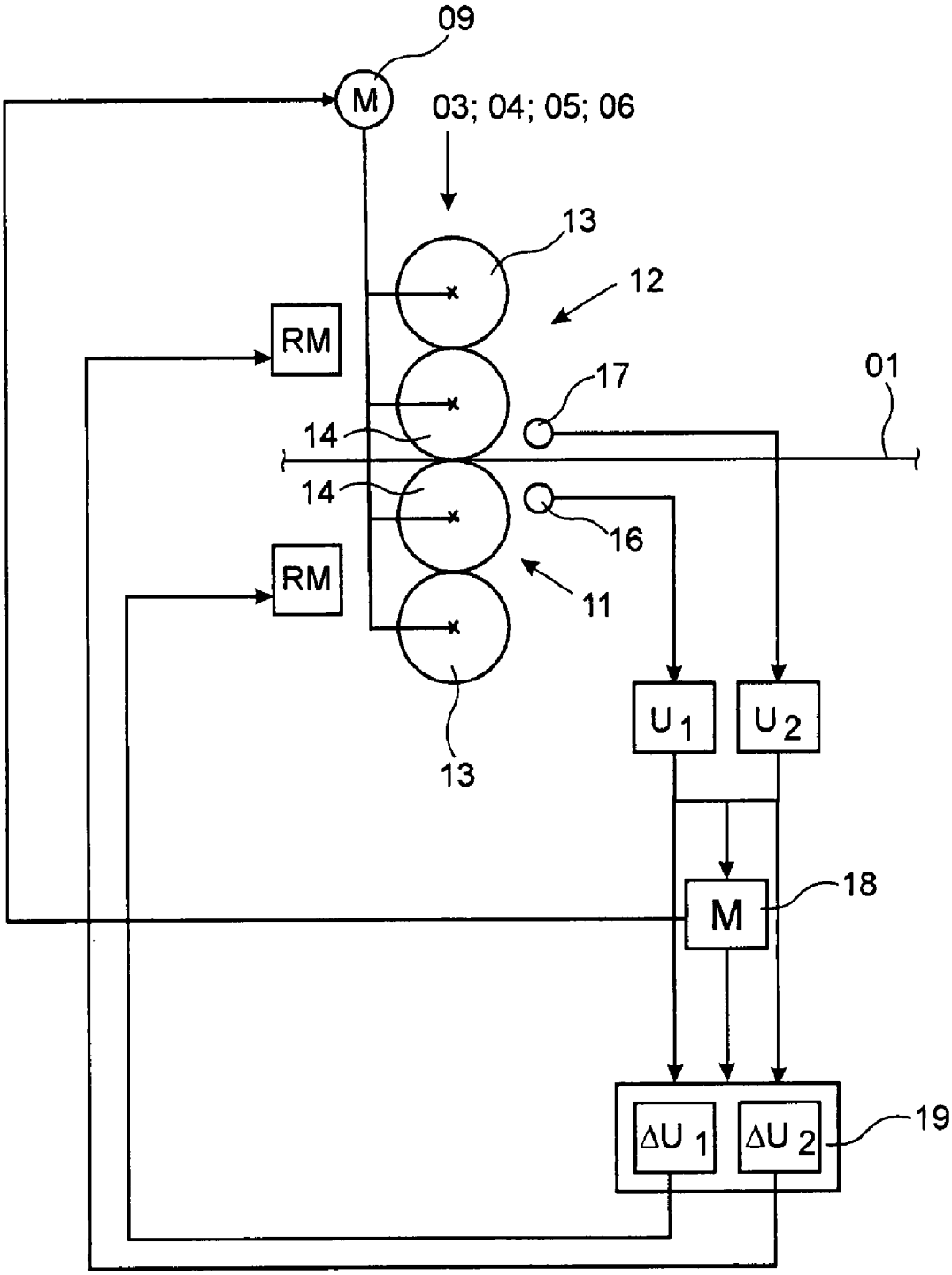
FIG. 2, a schematic representation of a first embodiment of a printing unit, in FIG. 3, a schematic representation of a second embodiment of a printing unit, in FIG. 4, a schematic representation of a web-fed rotary printing press with several webs and several printing units, and in FIG. 5, a schematic representation of a folding apparatus.

Only one printing unit 03 of the several printing units 03, 04, 05, 06 has been represented, for example, in FIG. 2. In connection with the preferred embodiment of the present invention, each one of the printing units 03, 04, 05, 06 is embodied as a double printing unit 03, 04, 05, 06 and therefore comprises two oppositely located printing groups 11, 12, each with a cylinder 13, such as, for example, a forme cylinder 13, and in particular a plate cylinder 13, and a cylinder 14, such as, for example, a transfer cylinder 14, and in particular a rubber blanket cylinder 14, wherein the two rubber blanket cylinders 14 are located opposite each other, forming a printing gap for the paper web 01 to be imprinted.

The plate cylinder 13, as well as the rubber blanket cylinders 14, each have a groove, which is not shown in detail, extending on their surface in the longitudinal direction of the respective cylinder 13, 14. Such a groove, in connection with the plate cylinders 13, is used for fastening the printing plate or plates. In connection with the rubber blanket cylinder 14, such a groove is used for fastening the rubber blanket or rubber blankets onto the surface of the blanket cylinder 14.

The method in accordance with the present invention represents a register control. This can either take place manually, i.e. the registration error is detected by the printing press operator, or it can be extended in the form of a regulation by an automatic deviation detection device, such as, for example, a sensor arrangement.

For example, for each printing group 11, 12 of each printing unit 03, 04, 05, 06, the control and/or regulation of the circumferential register includes an arrangement for determining the circumferential register deviation $U_1$, $U_2$. This deviation may be determined, in particular by a sensor device 16, 17 which, in a manner which is generally known, such as, for example, by the use of optical sensors, detects, by the sensing of register markings which are imprinted on the web 01 of material and/or the print image, the circumferential register deviations $U_1$ or $U_2$ between at least two printing groups 11 or 12 of two of the printing units 03, 04, which both imprint the same side of the web 01 of material, and/or between two printing groups 11, 12 outside of a printing unit 03, 04, 05, 06 and/or at least one printing group 11, 12 and a blade cylinder of the folding arrangement 08.

A mean value M is calculated, from the detected circumferential register deviations $U_1$, $U_2$, in an arithmetic device or a calculator or a first computing device 18, for forming a mean value, which calculation can be conducted, for example, in accordance with the equation:

$$M=(U_1+U_2)/2.$$

Furthermore, in a second computing device 19, for use in difference formation, the difference between the respective circumferential register deviation $U_1$ and $U_2$ and the mean value M is determined for each printing group 11, 12 of each one of the printing units 03, 04, 05, 06, i.e. the differential individual adjustment path $\Delta U_1=U_1-M$ and $\Delta U_2=U_2-M$.

It is understood that the control and/or the regulation of the circumferential register, which will now be explained in connection with the printing unit 03, 04, 05, 06, can be correspondingly also applied to all of the remaining, not specifically represented printing units 03, 04, 05, 06 of the web-fed rotary offset printing press.

In FIG. 2, the respective printing groups 11, 12 of the depicted one of the printing units 03, 04, 05, 06 each have a common main drive mechanism 09, as well as an individual circumferential register adjustment, by the provision of a respective register motor RM for each of the two plate cylinders 13. Each printing unit 03, 04, 05, 06 can also be configured as a satellite printing unit.

Assuming, for example, a groove width of a plate cylinder groove of 3.1 mm, and a groove width of the rubber blanket cylinder groove of 4.1 mm, a circumferential adjustment of +1 mm would be required in the printing group 11 and of +1.5 mm in the printing group 12 of the printing unit 03 in comparison with another printing unit 04, 05, 06.

In the above example adjustment, the adjustment of the main drive mechanism 09 of the printing unit 03, in relation to another printing unit 04, 05, 06, then amounts to M=+1.25 mm, because of which no groove widening is created, because the rubber blanket cylinders 14 are not adjusted with respect to each other in the printing unit 03. Then, the differential individual adjustment of the plate cylinder 13 in the printing group 11 is $\Delta U_1=+0.25$ mm, and in the printing group 12 $\Delta U_2=-0.25$ mm. In the selected example, the adjustment prescription, as a whole, would therefore not result in a groove widening.

In contrast thereto, if, in accordance with the prior art, only the plate cylinder circumferential register would be used for adjusting the required circumferential register, in the printing group 11 a groove widening of 0.5 mm would result, and in the printing group 12 a groove widening of 0.75 mm would result.

Figure 3:
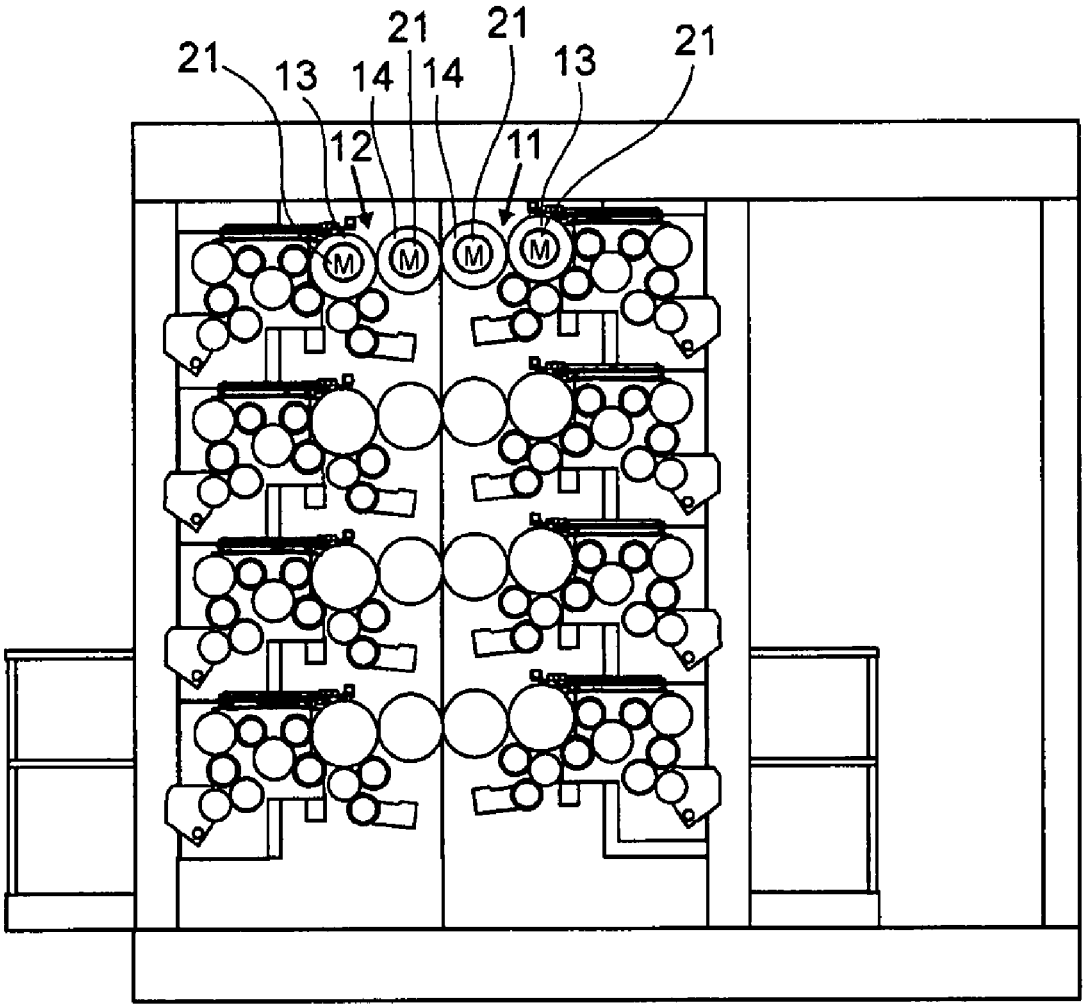
Figure 4:
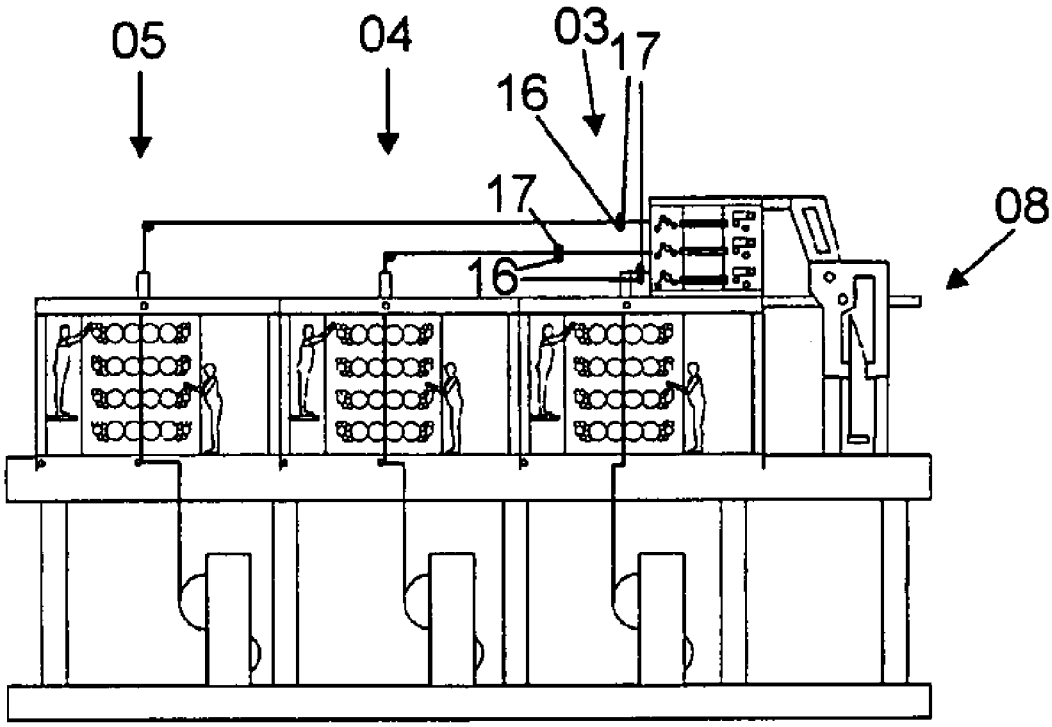
Figure 5:
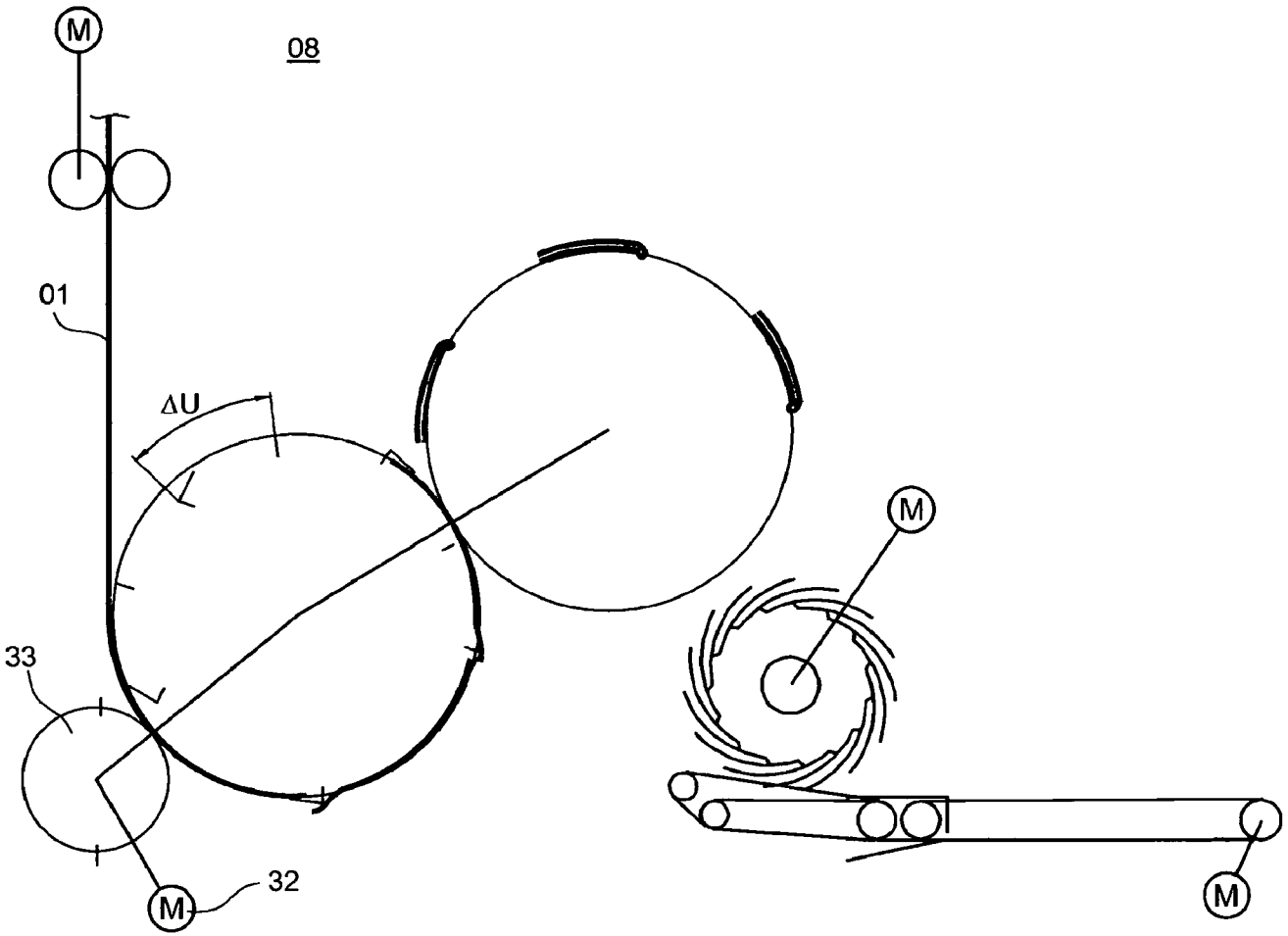

A further preferred embodiment of the present invention is represented in FIG. 3 and will be described in greater detail in what follows.

In this further preferred embodiment, as seen in FIG. 3, each plate cylinder 13 and blanket cylinder 14 of the printing group 03 has its own drive mechanism 21. Each such drive mechanism 21 is preferably configured as a position-controlled electric motor 21 and is preferably independent of other cylinders. In particular, each such drive mechanism 21 is not in positive drive connection with another cylinder.

Now, the mean value M is used as the correcting variable for the regulation of all of the individual drive mechanisms 21 of the printing unit 03. It represents the common adjustment path of the printing groups 11, 12 of the printing unit 03.

In the adjustment example, the common adjustment path of the drive mechanisms 21 of all cylinders 3, 14 then amounts to M=+1.25 mm, because of which no groove widening is formed. The differential individual adjustment of the plate cylinder 13 in the printing group 11 is $\Delta U_1=+0.25$ mm, and in the printing group 12 it is $\Delta U_2=-0.25$ mm. In the selected example, the adjustment prescription, as a whole, would therefore not result in a groove widening.

In contrast thereto, if, in accordance with the prior art, only the plate cylinder drive mechanism would be used for adjusting the required circumferential register, in the printing group 11 a groove widening of 0.5 mm would result, and in the printing group 12 a groove widening of 0.75 mm would result.

If, alternatively, the two drive mechanisms of the rubber blanket cylinder 14 and of the plate cylinder 13 of each of the printing groups 11, 12, in accordance with the prior art, would be together adjusted by the originally required amount $U_1$ or $U_2$, no groove widening would occur in the rubber blanket cylinder-plate cylinder nip, but a groove widening of 0.5 mm would occur in the rubber blanket cylinder-rubber blanket cylinder nip.

The differential amount of the circumferential register adjustment, which is individual for each of the printing groups 11, 12, is now used as the correcting variable for individual readjustment or re-regulation of the plate cylinder drive mechanism of each of the printing groups 11, 12 of the printing unit 03. This represents the differential individual adjustment path of the printing groups 11, 12 of the printing unit 03.

The arrangement 26 for regulating the cutting register, as may be seen in FIG. 1 comprises at least one sensor arrangement, such as, for example, a sensor device 16, 17, 27 which, in a manner which is generally known, detects, by the use of optical sensors and using register markings imprinted on the web 01 of material and/or print images, the register deviations ΔUS of the circumferential offsets, or register errors of the individual printing groups 11, 12 of the printing unit 03, 04, 05, 06 in relation to a cutting cylinder 33 of the folding arrangement 08, i.e. for example ΔUS1 in the printing group 11 or 12 of the printing unit 03, ΔUS2 in the printing group 11 or 12 of the printing unit 04, ΔUS3 in the printing group 11 or 12 of the printing unit 05, and ΔUS4 in the printing group 11 or 12 of the printing unit 06. The sensor device 27, for use in determining the cutting register, can be identical to the sensor device for use in detecting the circumferential register and/or can be used together with it. Thereafter, the register deviations ΔUS1, ΔUS2, ΔUS3, ΔUS4 of the detected circumferential offsets, or register errors, are weighted by calculation with a weighting factor a1, a2, a3 or a4 in a weighting arrangement 28, with respect to web length and/or coloration or amount of color, by the use of which, the respectively averaged register deviation G of the respectively weighted register deviations ΔUS1, ΔUS2, ΔUS3, ΔUS4 is obtained for each printing group of the printing units 03, 04, 05 or 06, i.e. G1=a1×ΔUS1, G2=a2×ΔUS2, G3=a3×ΔUS3, or G4=a4×ΔUS4. A mean value of the register deviation MS is calculated in the arithmetic or calculating device 29 for forming the mean value MS from the weighted register deviations G1, G2, G3, G4, namely in accordance with the equation MS=(G1+G2+G3+G4)/4.

Among other factors, the size of the possible cutting register fluctuations is a function of the web length and of the color and damping agent volume applied to the web 01 of material. The register fluctuations to be expected are all the greater the longer the web path to the follow-up processing unit 08 is and/or the greater the applied color and dampening agent volume is.

This mean value MS; which is formed from the weighted register deviations G1, G2, G3, G4, is now used as the correcting variable for regulating the follow-up processing unit 08, such as, in the case of the present preferred embodiment, the folding arrangement 08. In particular, the shaftless drive mechanism 32, as may be seen in of the folding arrangement 08, is regulated via the signal line 31, with respect to the angular position of the driven follow-up processing arrangement, such as, for example, the cutting cylinder 33. The position of the cutting cylinder 33 can be preset by the use of an angle encoder, which is assigned to the cutting cylinder 33, or via a virtual guide shaft.

Moreover, in the arrangement 26 for regulating the cutting register, the difference D is formed for each printing group 11, 12 of the printing unit 03, 04, 05, 06 in an arithmetic or calculating device 34 from the respective weighted register deviations G1, G2, G3, G4 and the mean value MS, i.e. D1=ΔUS1−MS, D2=ΔUS2−MS, D3=ΔUS3−MS and D4=ΔUS4−MS. This difference D is now used as the correcting variable for regulating the printing groups 11, 12 of the printing units 03, 04, 05, 06. In particular, the shaftless drive mechanisms of these printing groups 11, 12 of the printing units 03, 04, 05, 06 in particular are regulated via a signal line 36, with respect to the respective angular position of the respective forme cylinder 13.

The major part of the compensation of the cutting register deviation is performed via the regulation of the rotatory driveshaft of the folding arrangement 08. Only the clearly lesser portion, namely the respective difference D between the weighted register deviation D and the mean value MS of the deviation needs to be compensated by the regulation of the rotatory driveshafts of the printing groups of the printing units 03, 04, 05, 06.

Customarily, the sensor device 17, 16, 27 in the above preferred embodiment detects the respective circumferential deviations of the cylinders of the printing units 03, 04, 05, 06 in the form of a linear measurement. If now, in accordance with another preferred embodiment, the sensor device 16, 17, 27 emits a register signal only when a defined pre-settable threshold is exceeded, it is possible to calculate the common weighted register path to be adjusted as a function of the triggering web 01 of material and to regulate it out, and the difference D can be eliminated via the respective driveshafts of the printing units 03, 04, 05 or 06.

It is to be understood that the present invention is not to be limited to printing presses only with four printing groups. In general, the number of the printing groups is "i," wherein "i" is a whole number greater than 2. The weighted circumferential offset, or register error, of the respective printing group then is Gi=ai×ΔUi, and the mean value is M=ΣGi/i.

It is furthermore understood that the present invention can also be employed in printing presses wherein units other than folding arrangements 08 are used as follow-up processing units. For example cutting units, perforating units, stamping devices, collecting arrangements, or the like can be used as follow-up processing units. Moreover, such an independently driven unit can also be constituted in the form of traction rollers, skip slitters, register rollers, or the like.

Cutting register deviations of several, and in particular, of all webs covered in a printing press are preferably detected by the use of sensors. From this, a mean deviation of several, and in particular of all cutting registers is calculated, and the phase of a cutting cylinder of the follow-up processing unit 08, which transversely cuts several/all webs, is adjusted by this mean deviation in the circumferential direction relative to the printing groups. It is thus, for example, achieved that a major portion of the register offset is reduced even prior to this portion of the register offset occurring in the follow-up processing unit.

Preferably, an amount of a register deviation and/or an amount of a cutting register deviation is split into at least two partial amounts. The phases of two different cylinders are adjusted in the circumferential direction by the use of these two partial amounts.

The circumferential register adjustment of the printing groups and the cutting register adjustment can be combined with each other.

While preferred embodiments of methods for controlling and/or adjusting a register in a printing machine and a device for controlling and/or adjusting a circumferential register, in accordance with the present invention have been set forth fully and completely hereinabove, it will be apparent to one of skill in the art that various changes in, for example, the specific structures of the printing cylinders, the type of web being printed, and the like could be made without departing from the true spirit and scope of the present invention which is accordingly to be limited only by the appended claims.

What is claimed is:

1. A method for controlling a register in a printing press including:

providing at least one printing unit in said printing press;

providing at least two printing groups in said at least one printing unit;

providing each of said at least two printing groups having a cylinder pair including at least one forme cylinder and at least one transfer cylinder;

providing a processing station subsequent to said at least one printing unit, in a direction of web travel in said printing press and including a processing station cylinder enageable with the web;

determining an amount of a register deviation of each said at least two printing groups relative to said processing station;

forming a mean value from said register deviations of said at least two printing groups;

determining a difference between said register deviation of said at least two printing groups and said mean value;

adjusting a phase of said processing station in a circumferential direction in accordance with said mean value;

dividing said difference between said register deviation and said mean value into at least first and second register deviation components;

adjusting a phase of said one forme cylinder of said cylinder pair in a circumferential direction by a first forme cylinder phase circumferential amount for resister adjustment using said first register deviation component;

adjusting a phase of said one transfer cylinder of said cylinder pair in circumferential direction by a first transfer cylinder phase circumferential amount for register adjustment using said second register deviation component; and providing both said first forme cylinder phase circumferential amount and said first transfer cylinder phase circumferential amount different from each other and both different from zero.

2. The method of claim 1 further including providing several of said printing units located along a web to be printed; designating one of said printing units as a reference printing unit; setting circumferential registers of said at least two printing groups in said reference printing unit at a predetermined initial value and re- registering only printing groups of other ones of said printing units.

3. The method of claim 2 further including setting said predetermined initial value as zero.

4. The method of claim 1 further including providing separate electric drive motors for each of said cylinders in said at least one printing unit.

5. The method of claim 1 further including providing a single drive motor for each said printing unit and positively coupling all cylinders in each of said printing groups in directly opposite ones of said at least two printing groups in said at least one printing group for driving by a said single drive motor.

6. The method of claim 5 further including providing a register motor for displacing each said forme cylinder of each of said at least two printing units.

7. The method of claim 1 further including providing a cutting cylinder and in said processing station and having a cutting cylinder drive motor not positively connected with said printing units.

8. The method of claim 1 further including re-regulating angular positions of said cylinders.

9. The method of claim 1 further including weighting said register deviations prior to determining said mean value.

10. The method of claim 9 further including weighting said register deviation in accordance with web length.

11. The method of claim 9 further including weighting said register deviations in accordance with coloration of the web.

12. The method of claim 1 further including providing said processing station as a folding apparatus.

13. The method of claim 1 further including providing sensors and using said sensors for detecting said register deviations.

* * * * *